United States Patent [19]

Maurer

[11] Patent Number: 5,025,357

[45] Date of Patent: Jun. 18, 1991

[54] SUSPENDED ELECTRIC LAMP

[76] Inventor: Ingo Maurer, Kaiserstrasse 47, 8000 Muenchen 40, Fed. Rep. of Germany

[21] Appl. No.: 876,853

[22] PCT Filed: Sep. 18, 1985

[86] PCT No.: PCT/EP85/00485

§ 371 Date: May 19, 1986

§ 102(e) Date: May 19, 1986

[87] PCT Pub. No.: WO86/01872

PCT Pub. Date: Mar. 27, 1986

[30] Foreign Application Priority Data

Sep. 19, 1984 [DE] Fed. Rep. of Germany ..... 3434410

[51] Int. Cl.[5] ..... F21V 21/00

[52] U.S. Cl. ..... 362/249; 362/391; 362/396

[58] Field of Search ..... 362/391, 396, 249, 225, 362/252, 257, 285, 382, 393, 407, 418, 457, 458, 806

[56] References Cited

U.S. PATENT DOCUMENTS

| | | | |
|---|---|---|---|
| 1,813,863 | 7/1931 | Nightingale | 362/391 |
| 2,276,559 | 3/1942 | Bashore | 362/391 |
| 3,748,463 | 7/1973 | Trassinelli | 362/6 NK |
| 4,661,891 | 4/1987 | Kitamura | 362/396 |

FOREIGN PATENT DOCUMENTS

| | | | |
|---|---|---|---|
| 391629 | 11/1908 | France | 362/6 NK |

*Primary Examiner*—Raymond A. Nelli

*Attorney, Agent, or Firm*—Birch, Stewart, Kolasch & Birch

[57] ABSTRACT

A suspended electric lamp according to this invention is characterized in that the conducting wires at their ends are loosely connectable to two tensioned lead-in wires fed with low voltage.

6 Claims, 3 Drawing Sheets

SUSPENDED ELECTRIC LAMP

The invention relates to a suspended electric lamp with two conducting wires which serve for power supply and for holding the suspended lamp and further to a lighting system using such a suspended lamp.

Such suspended lamps of the above-described kind are already existing. Up-to-now such suspended lamps were mounted at the ceiling at a fixed point where the electric connector is arranged. Alternatively one can provide several connectors and the suspended lamp may be hung anew, e.g. by means of a plug connection. If the suspended lamp is required in more than one place, several electric connectors must be provided for, which is not very favorable with respect to the optic impression. If there is no plug connection, the lamp must be dismounted every time and has again to be assembled anew via lister connecting means.

In contrast thereto the invention is based on the object of creating an suspended electric lamp which can be arranged to one's liking within a large space without disconnecting it or without assembling work.

For this purpose the suspended electric lamp according to this invention is characterized in that the conducting wires at their ends are loosely connectable to two tensioned lead-in wires fed with low voltage.

In the suspended lamp according to this invention it is advantageous that it can be arranged to one's liking within the range of the tensioned lead-in wires without the necessity of changing connections or assembling works. Moreover, the simple way of connection between the conducting wires and the lead-in wires allows an esthetically attractive solution, as there is no need of connecting means between the conducting wires and the lead-in wires.

Advantageous embodiments of the connection between the conductive wires and the lead-in wires are provided in some examples of the present invention. In these examples there are no particular respective connecting means so that handling is simple.

In a further advantageous embodiment of the invention, a lighting system is created comprising a low-voltage source, at least two tensioned lead-in wires and at least one of the suspended lamps. The lead-in wires may be fixed in a pattern, e.g. several lead-in wires one beside another or in form of a grid. Thereby the region in which the suspended lamps can be arranged without difficulty is increased.

Now embodiments of the invention are explained with the aid of the enclosed drawings.

Figure 1:
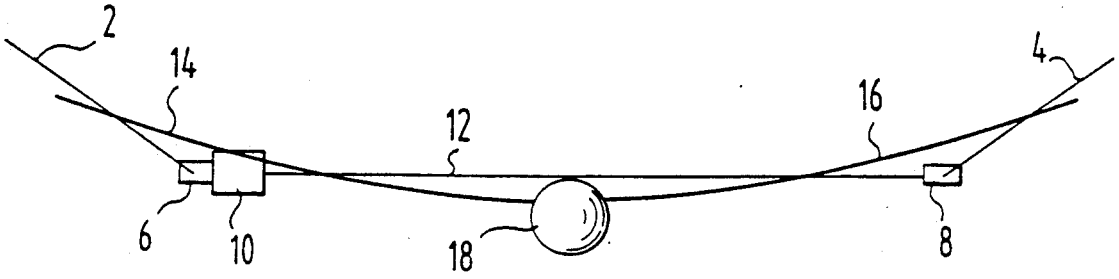
FIG. 1 shows a first embodiment of a suspended lamp with rigid conducting wires.

In FIG. 1 two lead-in wires 2, 4 are shown which for example are tensioned in a room from one wall to the other and are anchored in holding means 6, 8. The two lead-in wires 2, 4 are kept at a voltage of 0 V or 12 V, respectively, by a low-voltage source 10. A connecting line 12 between the low-voltage source and the holding means 8 is shown in FIG. 1, it can, however,—as usual—be concealed. The suspended lamp as shown in FIG. 1 comprises two rigid conducting wires 14, 16 and a spherical lamp 18. The two conducting wires 14, 16 end in a socket in the interior of the lamp 18 and thereby form a continuous suspension structure for the lamp 18, when the conducting wires 14, 16 are placed on the lead-in wires 2, 4 as is shown in FIG. 1.

Figure 2:
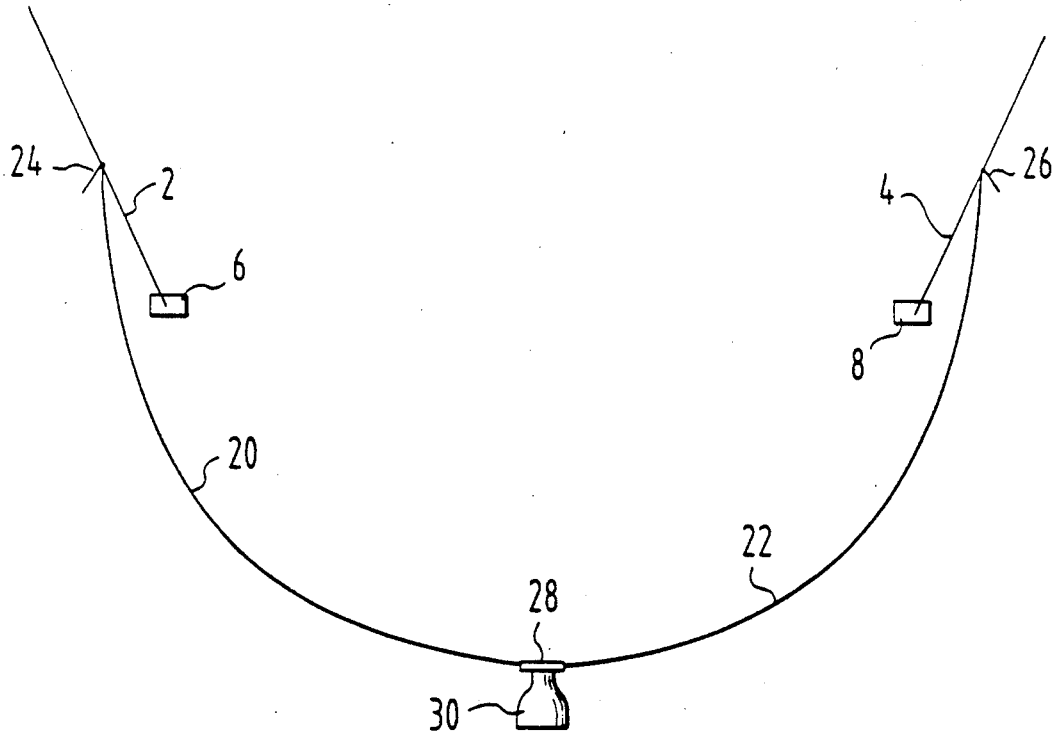
FIG. 2 shows a second embodiment of a suspended lamp with rigid conducting wires.

FIG. 2 shows the lead-in wires 2, 4 and the holding means 6, 8 whereas the low-voltage supply has been dropped for the sake of simplicity. The suspended lamp comprises two conducting wires 20, 22 which have hooks 24, 26 at their outer ends, with the aid of which hooks the conducting wires are hung into the lead-in wires 2, 4. From the hooks 24, 26 conducting wires 20, 22 run in an arc downwards to a lamp socket 28 in which they are fastened. Lamp 30 is fastened in the lamp socket 28.

Figure 3:
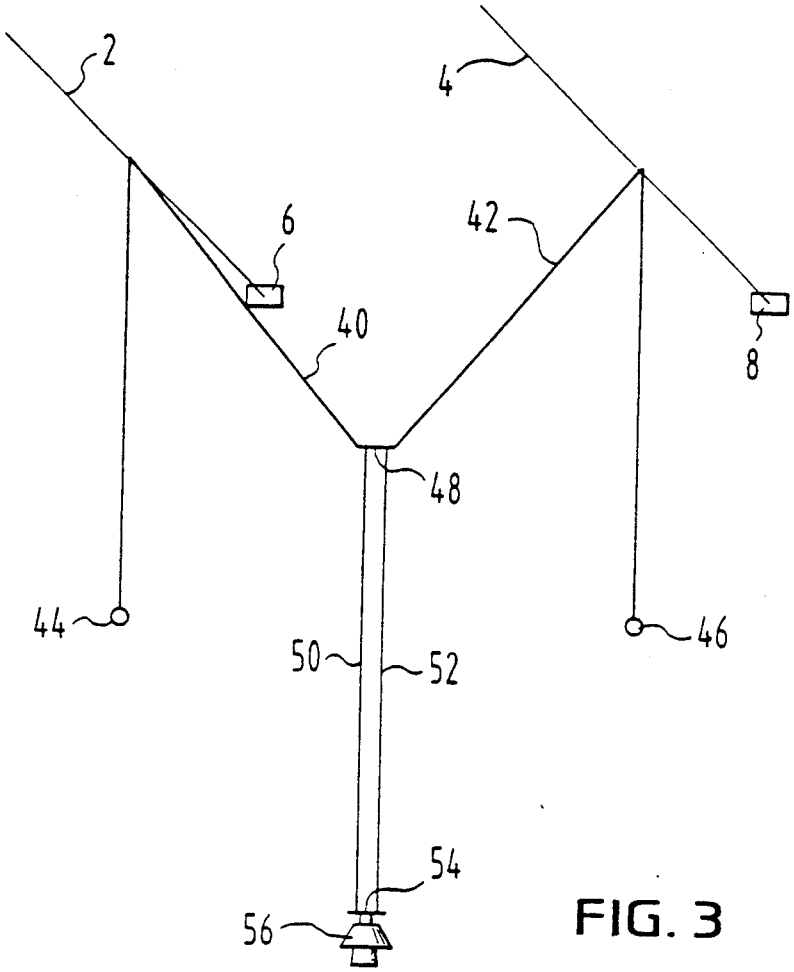
FIG. 3 shows an embodiment of a suspended lamp with flexible conducting wires.

FIG. 3 shows a further embodiment of a suspended lamp comprising two flexible conducting wires 40, 42 at the ends of which counter-weight means 44, 46 are arranged. The lamp-side ends of the conducting wires 40, 42 lead to a holding means 48 from which two parallel, rigid wires 50, 52 lead to the lamp socket 54 on which the lamp 56 is suspended. For mounting the suspended lamp only the ends with the counter-weight means 44, 46 are placed across the lead-in wires 2, 4, whereby the weight of the counter-weight means carries the lamp 56 and the parts connected thereto.

Figure 4:
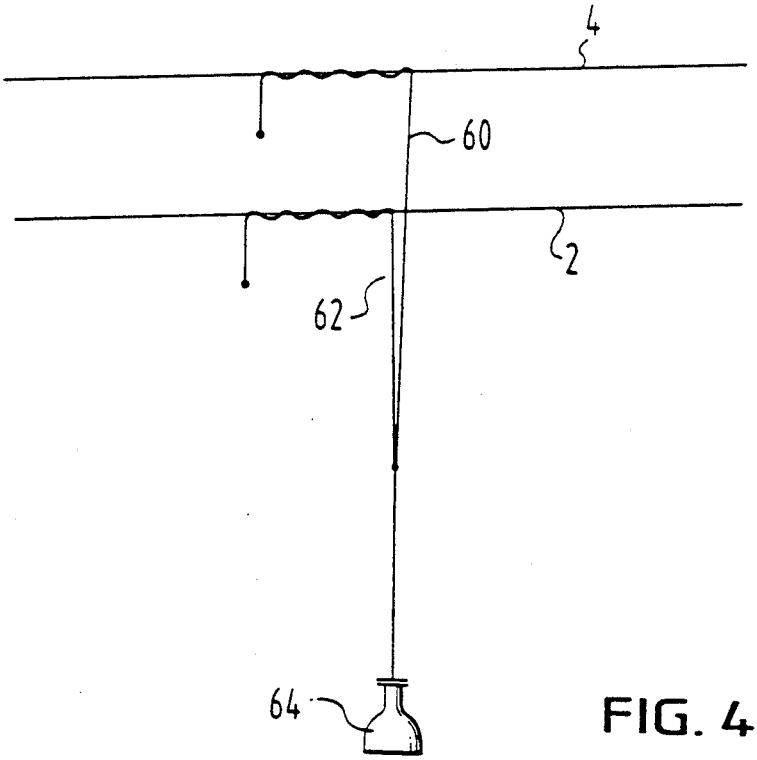
FIG. 4 shows a further embodiment of a suspended lamp with flexible conductive wires.

A further embodiment of a suspended lamp is shown in FIG. 4, the suspended lamp comprises two flexible conducting wires 60, 62 which are wound with their ends several times around the lead-in wires 2 and 4, respectively, and thus hold the lamp 64 in the desired position.

Figure 5:
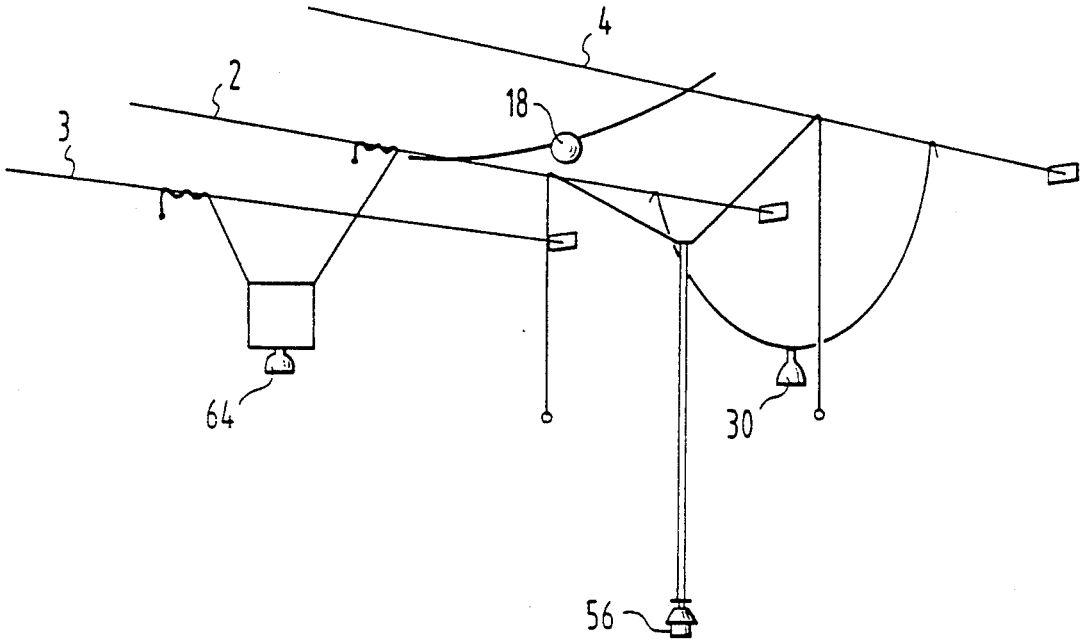
FIG. 5 shows an example of a lighting system with three lead-in wires and several suspended lamps of the kind shown in FIGS. 1–4.

FIG. 5 shows an arrangement with three lead-in wires 2, 3 and 4, thereby increasing the region in which the suspended lamps can be mounted. The arrangement of the lead-in wires is not limited to the arrangement shown, but the lead-in wires can also be suspended in a pattern or in form of a grid, whereby the variability of the lighting system is increased correspondingly.

I claim:

1. A suspended electric lamp comprising:

a light source;

two tensioned lead-in wires fed with low voltage;

two conducting wires, each having a first and second end, said conducting wires, supporting and serving as a power supply for said light source, said conducting wires being substantially flexible at least at said first ends thereof, said first ends of said conducting wires being each releasably connected to one of said two tensioned lead-in wires; and said first ends of said flexible conducting wires are wound around said lead-in wires.

2. The suspended lamp according to claim 1, including two parallel rigid wires and a holder wherein said two conducting wires are electrically connected to said light source by said two parallel rigid wires, said holder mechanically connecting said conducting wires to said two parallel rigid wires.

3. A suspended electric lamp comprising:

a light source;

two tensioned lead-in wires fed with low voltage; and two conducting wires, each having a first and second end, said conducting wires, supporting and serving as a power supply for said light source, said conducting wires being substantially flexible at least at said first ends thereof, said first ends of said conducting wires being each releasably connected to one of said two tensioned lead-in wires; and the first ends of said flexible conducting wires are placed across said lead in wires and carry at their first ends counter-weight means for counterbalancing the weight of said lamp source to hold said light source of the lamp in an operational position.

4. The suspended lamp according to claim 3, including two parallel rigid wires and a holder wherein said two conducting wires are electrically connected to said light source by said two parallel rigid wires, said holder mechanically connecting said conducting wires to said two parallel rigid wires.

5. A suspended electric lamp comprising:

a light source;

two tensioned lead-in wires fed with low voltage; and two conducting wires, each having a first and second end, said conducting wires, supporting and serving as a power supply for said light source, said conducting wires being substantially flexible at least at said first ends thereof, said first ends of said conducting wires being each releasably connected to one of said two tensioned lead-in wires; and two parallel rigid wires and a holder wherein said two conducting wires are electrically connected to said light source by said two parallel rigid wires, said holder mechanically connecting said conducting wires to said two parallel rigid wires.

6. A lighting system comprising a plurality of tensioned lead-in wires connected to a low-voltage source and at least one suspended lamp, said suspended lamp comprising: a light source; and two conducting wires supporting and serving as a power supply for said light source of the suspended electric lamp, said conducting wires being substantially rigid and running downward to a lamp socket of said light source and at least at first ends of said conducting wires being releasably connected to two tensioned lead-in wires of said plurality of tensioned lead-in wires.

* * * * *